US007396058B2

(12) United States Patent
Mariani

(10) Patent No.: US 7,396,058 B2
(45) Date of Patent: Jul. 8, 2008

(54) BALANCING APPARATUS

(75) Inventor: Eliseo Scott Mariani, Melbourne Beach, FL (US)

(73) Assignee: Northrop Grumman Corporation, Los Angeles, CA (US)

( * ) Notice: Subject to any disclaimer, the term of this patent is extended or adjusted under 35 U.S.C. 154(b) by 179 days.

(21) Appl. No.: 11/332,969

(22) Filed: Jan. 17, 2006

(65) Prior Publication Data

US 2007/0164577 A1 Jul. 19, 2007

(51) Int. Cl.
*B66C 1/42* (2006.01)

(52) U.S. Cl. ..... 294/67.5; 294/119.2

(58) Field of Classification Search ..... 294/67.21, 294/67.22, 67.5, 81.3, 81.4, 119.2
See application file for complete search history.

(56) References Cited

U.S. PATENT DOCUMENTS 2,156,862 A 5/1939 Maugard
2,832,630 A * 4/1958 Sterling ..... 294/119.2
2,925,300 A * 2/1960 Kelley ..... 294/86.41
2,966,380 A 12/1960 Swenson
3,253,851 A 5/1966 Gilbert
3,406,845 A * 10/1968 Fahey ..... 414/277
3,433,459 A 3/1969 Logan
3,751,097 A 8/1973 Jones et al.
3,762,755 A * 10/1973 Saether ..... 294/67.21
3,915,311 A 10/1975 Ball et al.
3,998,488 A * 12/1976 Durgan ..... 294/67.21
4,355,832 A * 10/1982 Andersen ..... 294/81.3
4,597,602 A 7/1986 McGriff
4,615,656 A * 10/1986 Geraghty, Jr. ..... 414/607
4,626,012 A * 12/1986 Weldele ..... 294/81.3
5,203,837 A 4/1993 Madic et al.
5,501,497 A * 3/1996 Holloway ..... 294/86.4
6,450,706 B1 9/2002 Chapman

* cited by examiner

*Primary Examiner*—Dean J Kramer
(74) *Attorney, Agent, or Firm*—Robert P. Lenart, Esq.; Pietragallo Gordon Alfano Bosick & Raspanti

(57) ABSTRACT

An apparatus comprises a frame, a counterweight connected to the frame, a load attachment member connected to the frame, a movable pick point mounted on the frame, and a pick point position adjuster for moving the pick point to balance a load supported by the load attachment member.

7 Claims, 2 Drawing Sheets

BALANCING APPARATUS

STATEMENT OF GOVERNMENT INTEREST

This invention was made under Contract No. N00024-02-C-6324. The United States Government has rights in this invention under the contract.

FIELD OF THE INVENTION

This invention relates to apparatus for balancing loads and positioning the loads in a desired orientation.

BACKGROUND OF THE INVENTION

When a component of a device is to be inserted into or mounted on the device, it is important to position the component in a desired orientation for easy assembly. For example, a Rapid Airborne Mine Clearance System (RAMICS) is a helicopter-borne weapon system that will fire projectiles from a modified Gatling gun controlled by a blue-green Light Detection and Ranging (LIDAR) sensor. The LIDAR locates and targets the mine and provides aiming coordinates to the gun's fire-control system. Rounds are fired at the mine in bursts, resulting in neutralization.

The RAMICS includes a closed vessel in the form of a cylindrical pod that contains the LIDAR sensor. In order to ensure personnel safety and prevent damage to the sensor when assembling the LIDAR sensor assembly into a RAMICS pod, the sensor assembly must be properly oriented to slide into the pod.

Various conditions might cause a departure from the static center of gravity (c.g.) of the sensor assembly. These conditions include, but are not limited to: 1) components not installed in the LIDAR assembly due to availability; 2) an uneven distribution of coolant in the mated units; and 3) coolant and/or interconnect cables added to the mated assembly prior to installation in order to ease integration. Because of the potential variability in the load balance of the sensor assembly, a fixed pick point apparatus is impractical.

There is a need for an adjustable balancing apparatus that can be used to orient a load (such as a sensor assembly) for assembly into a device.

SUMMARY OF THE INVENTION

This invention provides an apparatus comprising a frame, a counterweight connected to the frame, a load attachment member connected to the frame, a movable pick point mounted on the frame, and a pick point position adjuster for moving the pick point to balance a load supported by the load attachment member.

DETAILED DESCRIPTION OF THE INVENTION

Figure 1:
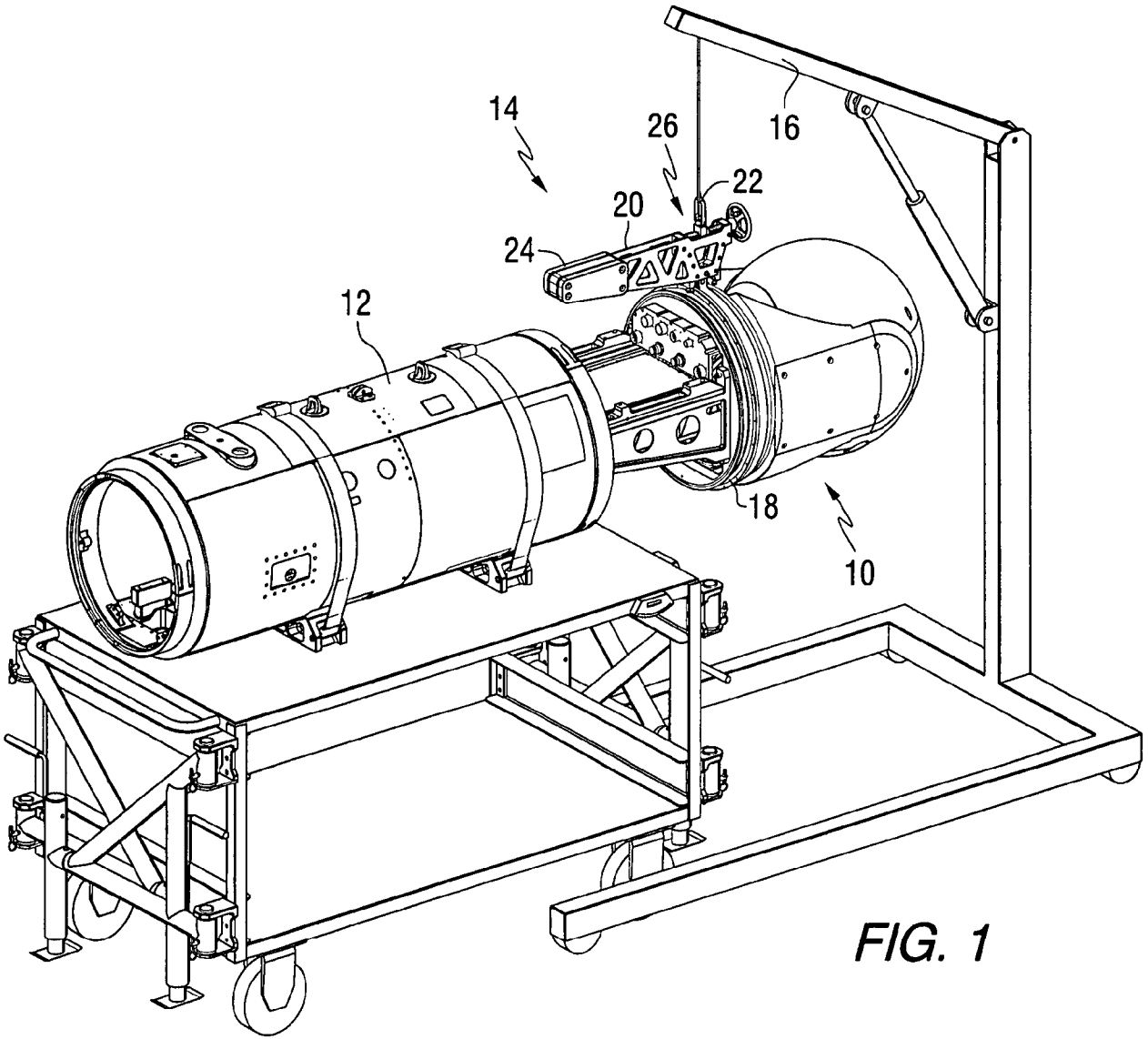
FIG. 1 is a pictorial representation of a system that can include the apparatus of the invention.

FIG. 1 is a pictorial representation of a system that can include the apparatus of the invention. FIG. 1 illustrates the use of the invention for positioning a sensor assembly 10 prior to insertion of the sensor assembly into a cylindrical pod housing 12. In the system of FIG. 1, the invention provides a balancing apparatus 14 that is used to couple a sensor assembly 10 to a hoist or lift 16. The sensor assembly must be properly positioned to slide into the housing. The balancing apparatus includes a load attachment member in the form of a band 18 that is used to attach the balancing apparatus to a load, in this case a sensor assembly. The balancing apparatus includes a frame 20 connected to the band, a pick point or lifting lug 22 for connection to a lifting or holding device, a counterweight 24, and a pick point position adjuster 26 for adjusting the position of the lifting lug. In this example, the pick point position adjuster includes a screw 28 and a manually rotatable wheel 30 that is used to turn the screw. The lifting lug is coupled to the screw such that rotation of the screw causes linear movement of the lifting lug.

This invention provides an adjustable balancing apparatus that can be used to orient the sensor assembly for assembly into the pod. The balancing apparatus allows for attachment to standard ground handling equipment. While FIG. 1 shows the use of the invention to balance a sensor assembly, it should be apparent that the invention could be used to balance other devices. As used in this description, a load is a device that can be attached to the invention, and the invention is used to balance the load.

Figure 2:
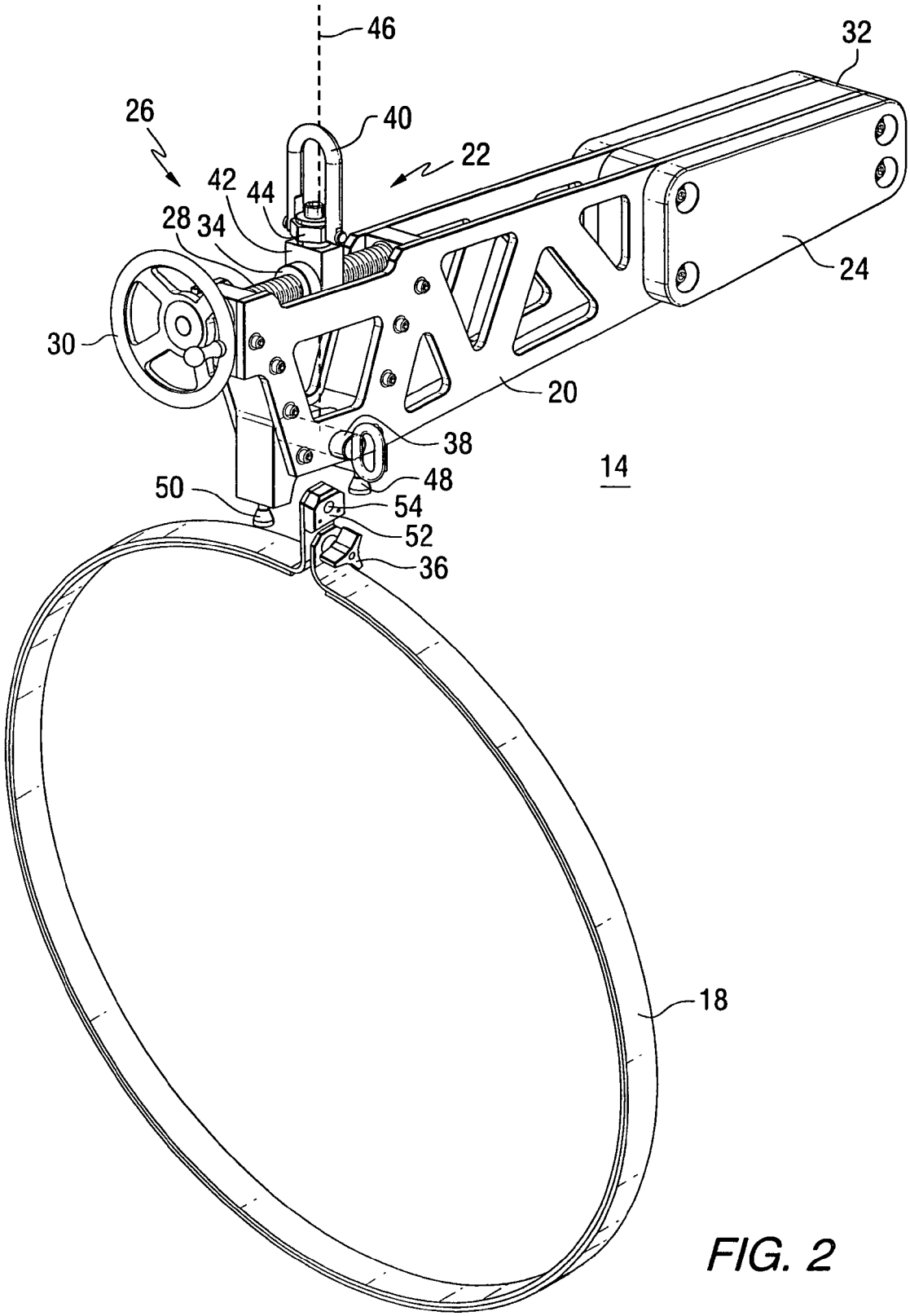
FIG. 2 is an isometric view of a balancing apparatus constructed in accordance with an embodiment of the invention.

FIG. 2 is an isometric view of a balancing apparatus 14 constructed in accordance with an embodiment of the invention. The balancing apparatus includes a load attachment member in the form of a band 18 that is used to attach the balancing apparatus to a load. The balancing apparatus also includes a frame 20 connected to the band, a pick point 22 for connection to a hoist or lift, a counterweight 24 mounted near a first end 32 of the frame, and a pick point position adjuster 26 for moving the pick point to balance a load supported by the load attachment member. The pick point adjuster serves as a means for adjusting the position of the pick point. In this example, the pick point adjuster includes a screw 28 and a manually rotatable wheel 30 that is used to turn the screw. The pick point is coupled to the screw such that rotation of the screw causes linear movement of the pick point. In operation, the balancing apparatus is attached to a load and the combination of the balancing apparatus and the load is suspended from a hoist or other lifting device. The wheel is then turned to move the position of the pick point until the desired position of the load is achieved. A translation-securing nut 34 is provided to secure the hoist point at a desired location after the balance of an attached load has been adjusted.

The band clamp includes a bolt 36 for tightening the band, and is connected to the frame near the bottom of the frame. The band clamp is secured to the frame by a load attach pin 38. The band clamp is allowed to pivot so that the band does not bind when lifting the load.

The pick point includes a lifting lug 40 connected to a translating nut 42 by a swivel connection 44. The translating nut includes a threaded bore that has threads matching the threads of the screw 28 such that rotation of the screw causes linear motion of the pick point. Once the desired amount of linear motion has been achieved, the translation-securing nut 34 can be tightened against the translating nut to prevent further movement of the pick point. The pick pin can be positioned directly above the load attach pin, or on either side of a vertical line 46 passing through the load attach pin. The nominal location of the translating nut for the known static center of gravity is directly over the pick pin.

Load stabilizers 48 and 50 are positioned on opposite sides of the band attachment point. Because the band clamp is allowed to rotate, any departure of the combined center of gravity of the load will cause the load to want to rotate in order to achieve equilibrium. The load stabilizers are adjusted down, one side or the other, until they contact the load prior to lifting. The load stabilizers prevent the load from rotating and allow the apparatus and load to be adjusted as a single unit.

In FIG. 2, the band is shown in a detached position below the frame. The band includes a block 52 having an opening 54. When the band is attached to the frame, the pin 38 extends through the opening 54. Block 52 acts as a spacer to take out any free play between the band and the frame.

The counterweight includes a plurality of plates attached to the frame. The number or weight of the plates can be changed to adjust the total weight of the counterweight.

In one embodiment, the balancing apparatus is approximately 2 ft×6 in×4 in (60.9 cm×15.2 cm×10.2 cm) wide, weighs approximately 22 lbs. (10 kg), and has a hand wheel to allow for easy adjustment of unbalanced loads. The balancing apparatus can be constructed using an aluminum frame with steel counterweight plates. The balancing apparatus can include a band clamp assembly attached to the main translating unit via a quick disconnect pin 36. The translation-securing nut 34 is provided to secure the translating nut prior to mating procedures.

In the embodiment shown in the figures, the attachment member is a band that can be easily fitted on a cylindrical portion of a sensor assembly. It should be recognized that different attachment members could be used to accommodate different loads. Any cantilevered load of known but variable c.g. could potentially take advantage of this design.

While the invention has been described in terms of an embodiment that is used to position a sensor assembly, it will be apparent to those skilled in the art that various changes can be made to the described embodiment, and the balancing apparatus can be used with various types of loads, without departing from the scope of the invention as set forth in the following claims.

What is claimed is:

1. An apparatus comprising:

a frame;

a counterweight connected to the frame;

a load attachment member connected to the frame;

a movable pick point mounted on the frame;

a screw coupled to the movable pick point for moving the pick point to balance a load supported by the load attachment member, wherein rotation of the screw produces linear movement of the pick point;

a lug coupled to a translating nut by a swivel connection, wherein the screw passes through the translating nut; and a translation-securing nut, wherein the screw passes through the translation-securing nut.

2. The apparatus of claim 1, further comprising:

a wheel coupled to the screw.

3. The apparatus of claim 1, wherein the load attachment member comprises:

a clamp ring.

4. The apparatus of claim 3, wherein the clamp ring is connected to the frame by a pin.

5. The apparatus of claim 1, further comprising:

load stabilizers extending from the frame on opposite sides of the load attachment member.

6. An apparatus comprising:

a frame;

a counterweight connected to the frame;

a clamp ring connected to the frame by a pin;

a movable pick point mounted on the frame;

a screw coupled to the movable pick point such that rotation of the screw produces linear movement of the pick point to balance a load supported by the clamp ring;

a lug coupled to a translating nut by a swivel connection, wherein the screw passes through the translating nut;

a translation-securing nut, wherein the screw passes through the translation-securing nut; and load stabilizers extending from the frame on opposite sides of the clamp ring.

7. The apparatus of claim 6, further comprising:

a wheel coupled to the screw.

* * * * *